United States Patent [19]

Granetzke

[11] Patent Number: 4,633,939

[45] Date of Patent: Jan. 6, 1987

[54] HEAT TRANSFER DEVICE FOR OIL TEMPERATURE REGULATOR

[75] Inventor: Dennis C. Granetzke, Racine, Wis.

[73] Assignee: Modine Manufacturing, Racine, Wis.

[21] Appl. No.: 348,096

[22] Filed: Feb. 11, 1982

[51] Int. Cl.[4] ..... B28D 7/10

[52] U.S. Cl. ..... 165/154; 165/76; 29/157.3 R

[58] Field of Search ..... 165/154, 183, 76, 185

[56] References Cited

U.S. PATENT DOCUMENTS

| | | | |
|---|---|---|---|
| 2,119,761 | 6/1938 | Wentworth | 165/183 |
| 2,261,136 | 11/1941 | Brown, Jr. | 165/183 |
| 2,692,763 | 10/1954 | Holm | 165/154 |
| 3,305,013 | 2/1967 | Friedl et al. | 165/183 |
| 3,636,607 | 1/1972 | DeMarco | 29/157.3 R |
| 4,059,882 | 11/1977 | Wunder | 165/154 X |

*Primary Examiner*—William R. Cline

*Attorney, Agent, or Firm*—Wood, Dalton, Phillips, Mason & Rowe

[57] ABSTRACT

A heat transfer device comprising in one embodiment concentric tubes with spaced surfaces to define a fluid flow space through which a heat transfer fluid is directed and with this space being spanned by a series of fins extending between the tubes with at least one of the tubes being provided with spaced contact members extending toward the other tube and engaging the fins compressively to provide snug heat transfer contact between the boundary members or tubes and the fins so as to compensate for variations in the dimensions in one or both of the tubes and fins.

11 Claims, 4 Drawing Figures

HEAT TRANSFER DEVICE FOR OIL TEMPERATURE REGULATOR

BACKGROUND OF THE INVENTION

As is disclosed in copending application of Norman F. Costello et al. Ser. No. 286,568 filed July 24, 1981, now U.S. Pat. No. 4,401,091, one form of heat transfer device, shown embodied in an oil temperature regulator, includes a flow passage for one of the fluids defined by spaced surfaces of first and second boundary members and specifically of substantially concentric tubes. The intervening space is bounded by generally radiating fins of a soft metal such as copper, brass or the like that are very thin and usually provided with louvers so as to cause turbulence and efficient heat transfer between one of these boundary members or tubes and the fluid flowing through the space and the fins.

The fin that spans the fluid space is conveniently a serpentine fin strip having opposite crests adjacent the spaced surfaces. This serves as a heat transfer fin and as a turbulator as mentioned above. In many embodiments, the inner boundary member or tube is made of molded plastic. In addition, the fin height of the strip or the spacing between the sets of opposite crests varies from the intended dimensions and results frequently in a loose fit of the fin within the space thereby reducing the heat transfer from the boundary member or members to the fin and to the fluid flowing through the space.

The present invention provides a structure that is self-compensating so that regardless of variations of dimensions of the fin or fin strip, there is always provided a close and thereby effecient heat conducting relationship between the inner and outer tubes and the fin regardless of normal variations in dimensions from the design dimensions.

SUMMARY OF THE INVENTION

In this invention, the inner and outer tubes or, broadly, the first and second boundary members that have surfaces spaced apart to define the fluid flow space have at least one of these boundary members provided with spaced contact members. These can be spaced separate rings, or integral ridges, having peaks projecting slightly toward the other boundary member or tube so as to engage the fin sections and compress them slightly, where necessary, to insure a snug fit. These may be either separate rings or may be integral with the boundary member or tube and may be either on the inner surface of the outer boundary member or the outer surface of the inner boundary member.

BRIEF DESCRIPTION OF THE PREFERRED EMBODIMENT

Figures 1, 2, 3, 4:
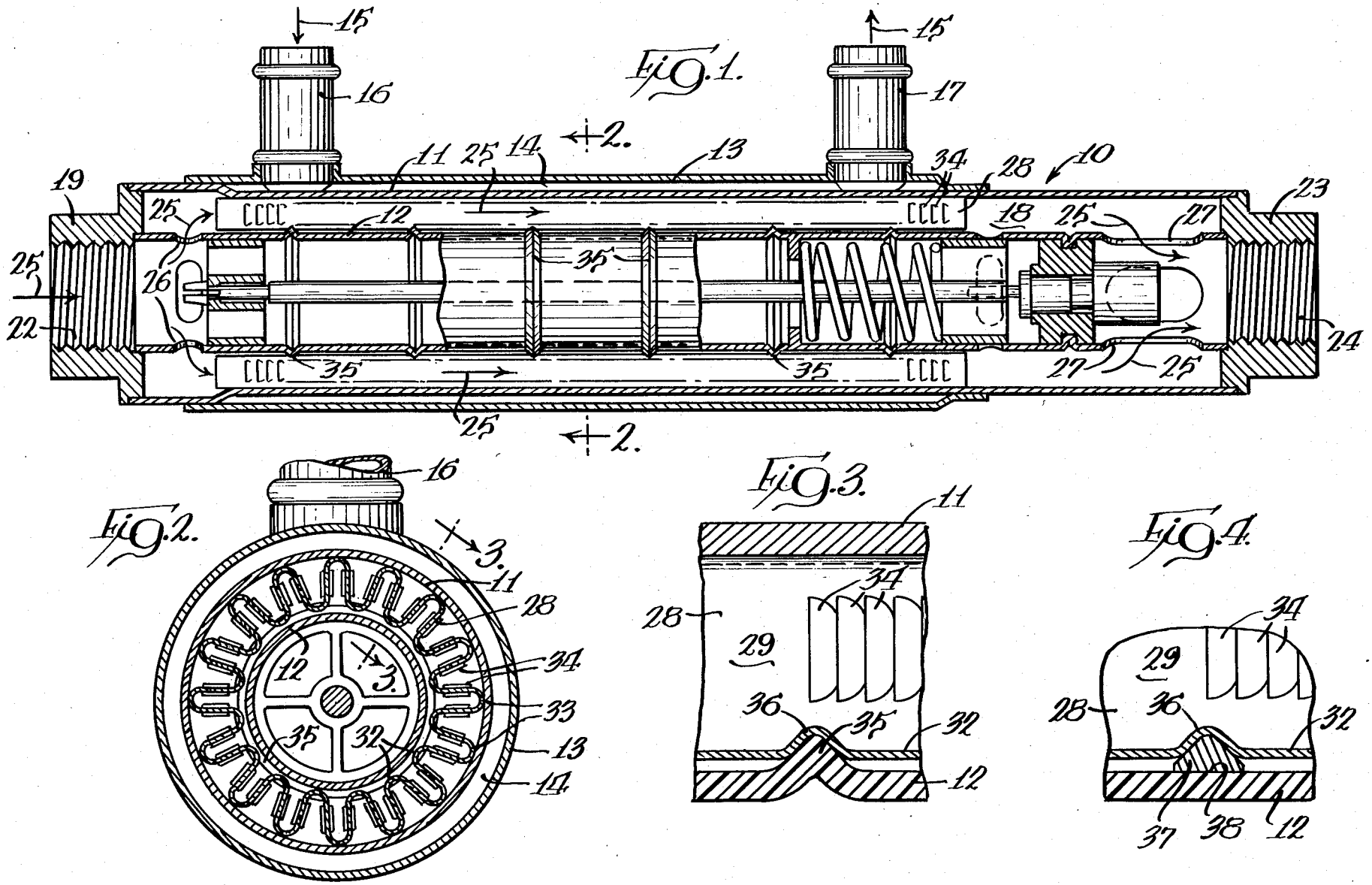
FIG. 1 is a longitudinal section through a heat transfer device, and particularly an oil temperature regulator, of the type described in the above Costello et al. application Ser. No. 286,568.
FIG. 2 is a transverse section taken substantially along line 2—2 of FIG. 1.
FIG. 3 is an enlarged detail sectional view taken substantially along line 3—3 of FIG. 2.
FIG. 4 is a view similar to the bottom portion of FIG. 3 illustrating a second embodiment of the invention.

In the illustrated embodiment, the oil temperature regulator comprises an outer tube 11 and an inner tube 12 with the tube 11 being surrounded by water jacket tube 13 spaced from the outer tube 11 to provide a water jacket 14 through which heated water 15 may flow as from an engine water jacket. This water flows into the space 14 by way of an inlet fitting 16 and an outlet fitting 17.

The inner and outer tubes 11 and 12 that define the fluid space 18 between them are connected at one end of each by an inlet fitting 19 having a coaxial entrance 22.

The opposite ends of the tubes 11 and 12 are connected by an outlet fitting 23 having a coaxial exit opening 24.

In the illustrated embodiment, the heated liquid coolant or water 15 heats oil 25 that is directed into and through the space 18 and exit opening 27 from this space and through the axial exit opening 24. The temperature controlled valve arrangement of the illustrated embodiment here is described in detail and claimed in the above Costello et al. application and forms no part of the present invention except for the common details shown and described in the two applications.

The fluid flow space 18 between the tubes 11 and 12 is spanned by the heat transfer member 28 in the form of a serpentine fin strip having radial sides 29 connected by inner 32 and outer 33 crests. Each of the sides 29 is provided with spaced integral louvers 34 struck from the sides so as to create turbulence.

As is customary in this art, the serpentine fin 28 may be constructed of soft deformable metal such as a thin sheet of copper, brass or the like. These fins often vary in dimensions from manufacturer to manufacturer and will even vary one from the other for each individual manufacturer. Therefore, some of the fins 28 will have a more or less loose fit within the flow space 18 and this is particularly true when one or both of the inner and outer tubes 11 and 12 are made of a rigid plastic.

Any loose fit will of course reduce the efficiency of the heat transfer from the outside of the space 18 such as from the coolant jacket 14 to the liquid 15 flowing through the space 18. In order to overcome this problem, the invention provides spaced contact members on at least one of the boundary members 11 and 12 for engaging the heat transfer member fin 28 compressively to provide snug heat transfer contact between these boundary members or tubes and the heat transfer member or fin 28.

In the embodiment of FIGS. 1–3, these contact members are in the form of spaced, annular, ring-shaped ridges 35 integral with and forming a part of inner tube 12. As can be seen in FIG. 3, these ring-shaped ridges 35 deform a section 36 of the fin crests 32 thereby forming a snug, highly efficient heat transfer contact between the outer tube 11, the fin 29 and the inner tube 12.

In this embodiment, the rings or ridges 35 are integral with one of the tubes, here the inner tube 12. In this embodiment of FIG. 4, the rings 37 are separate from the tube 12 but are now in very close contact with the tube at the contact surfaces 38. Thus, in this embodiment as in the first embodiment, the compressive rings 37 deform the fin 28 at the crests 32 to achieve snug, highly efficient heat transfer contact between the tube 11 and the intermediate fin 28.

In manufacturing the transfer device of this invention as illustrated in the two embodiments of the drawings, the fin ring 28 is placed in the interior of the exterior tube 11, and then the inner tube 12 is pushed through the inside of the fin ring 28, thereby forming a tight fit between the fin ring and the tubes.

I claim:

1. A heat transfer device comprising:

first and second boundary members having surfaces spaced apart to define a fluid flow space;

a heat transfer member substantially spanning said space to be contacted by said fluid, said member comprising a deformable heat transfer material; and spaced contact members on one of said boundary members engaging, at correspondingly spaced locations, said heat transfer member compressively to provide snug heat transfer contact between said boundary members and said heat transfer member.

2. The device of claim 1 wherein said first and second boundary members comprise substantially concentric tubes and said heat transfer member has portions extending substantially radially of said tubes.

3. The device of claim 2 wherein said tubes are essentially concentric and said heat transfer member comprises a continuous serpentine fin of thin metal with opposite crests adjacent said boundary surfaces.

4. The device of claim 1 wherein said contact members comprise rings at said spaced location on said one boundary member and engaging and deforming the heat transfer member.

5. The device of claim 4 wherein said rings are integral with said one boundary member.

6. The device of claim 4 wherein said rings are separate from but mounted on said one boundary member.

7. A heat transfer device comprising:

first and second concentric tubes defining boundary members having surfaces spaced apart to define a fluid flow space;

a heat transfer fin substantially spanning said space to be contacted by said fluid, said fin comprising a deformable heat transfer metal; and spaced rings on one of said boundary members each having a crest engaging said fin at an edge thereof compressively to provide snug heat transfer contact between said tubular means and said heat transfer member.

8. The device of claim 7 wherein said tubes are essentially concentric and said heat transfer member comprises a continuous serpentine fin of thin metal with opposite crests adjacent said boundary surfaces.

9. The device of claim 7 wherein said contact members comprise spaced rings on said one boundary member and engaging and deforming the heat transfer member.

10. The device of claim 9 wherein said rings are integral with said one boundary member.

11. The device of claim 9 wherein said rings are separate from but mounted on said one boundary member.

* * * * *